US009561539B2

(12) United States Patent
Sugita et al.

(10) Patent No.: US 9,561,539 B2
(45) Date of Patent: Feb. 7, 2017

(54) GAS PRESSURE CONTROLLED CASTING MOLD

(75) Inventors: Kaoru Sugita, Shizuoka (JP); Takeshi Fujita, Shizuoka (JP); Eikichi Sagisaka, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 559 days.

(21) Appl. No.: 13/000,086

(22) PCT Filed: Jun. 30, 2008

(86) PCT No.: PCT/JP2008/061873
§ 371 (c)(1),
(2), (4) Date: Dec. 20, 2010

(87) PCT Pub. No.: WO2010/001459
PCT Pub. Date: Jan. 7, 2010

(65) Prior Publication Data
US 2011/0100582 A1 May 5, 2011

(51) Int. Cl.
*B22D 11/041* (2006.01)
*B22D 11/049* (2006.01)
(Continued)

(52) U.S. Cl.
CPC ..... *B22D 11/0401* (2013.01); *B22D 11/049* (2013.01); *B22D 11/07* (2013.01)

(58) Field of Classification Search
CPC ..... B22D 7/106; B22D 11/0401; B22D 11/07; B22D 11/049
(Continued)

(56) References Cited

U.S. PATENT DOCUMENTS 4,157,728 A 6/1979 Mitamura et al.
4,214,624 A * 7/1980 Foye et al. ..... 164/487
(Continued)

FOREIGN PATENT DOCUMENTS

EP 0 499 563 A1 8/1992
EP 620062 A1 * 10/1994
(Continued)

OTHER PUBLICATIONS

English Translation, mailed Feb. 17, 2011, of the International Preliminary Report on Patentability (Chapter1) issued by the International Bureau for the corresponding International Application.
(Continued)

*Primary Examiner* — Kevin E Yoon
*Assistant Examiner* — Jacky Yuen
(74) *Attorney, Agent, or Firm* — Young Basile Hanlon & MacFarlane, P.C.

(57) ABSTRACT

A gas pressure controlled casting mold is disclosed having a hot-top introducing a molten metal of aluminum or aluminum alloy, and a mold body which passes the molten metal of aluminum or aluminum alloy introduced from the hot-top through a molten metal passage portion for cooling and solidification and semi-continuously or continuously casting a billet of aluminum or aluminum alloy. A wall surface of the molten metal passage portion of the mold body is provided with a plurality of lubricating oil blow-out holes for blowing out a lubricating oil. A lubricating oil supply passage is communicatively connected to each lubricating oil blow-out hole and is independently formed at least in a range of a heat affected portion in the mold body. This allows the mold body to be reliably cooled regardless of the difference in the temperature and casting speed conditions and thus can achieve favorable continuous casting.

20 Claims, 9 Drawing Sheets

(51) Int. Cl.
*B22D 11/07* (2006.01)
*B22D 11/04* (2006.01)

(58) Field of Classification Search
USPC ..... 164/472, 475, 485–487
See application file for complete search history.

(56) References Cited

U.S. PATENT DOCUMENTS

| | | | | |
|---|---|---|---|---|
| 5,678,623 | A * | 10/1997 | Steen et al. | 164/268 |
| 7,143,810 | B1 * | 12/2006 | Johansen et al. | 164/440 |
| 2002/0139508 | A1 | 10/2002 | Schneider et al. | |
| 2005/0061468 | A1 | 3/2005 | Schneider et al. | |

FOREIGN PATENT DOCUMENTS

| | | | | |
|---|---|---|---|---|
| JP | 5413421 | A | | 1/1979 |
| JP | 5442847 | B | | 12/1979 |
| JP | S57-47556 | A | | 3/1982 |
| JP | S57-050250 | A | | 3/1982 |
| JP | 63104751 | A | | 5/1988 |
| JP | 63154244 | A | | 6/1988 |
| JP | 03-004342 | U | | 1/1991 |
| JP | 05200513 | A | * | 8/1993 |
| JP | 06-047504 | A | | 2/1994 |
| JP | 96029398 | B2 | * | 3/1996 |
| JP | 2002301547 | A | | 10/2002 |
| WO | 01/00353 | A1 | | 1/2001 |

OTHER PUBLICATIONS

Translation of Chinese Office Action, Patent Application No. 200880130132.9 dated Apr. 9, 2013.

Qu et al., Application of Air Film Lubricating Technology in the Process of Aluminum Continuous Casting, Key Lab of Electromagnetic Processing of Materials, Northeastern University, Shenyang, Abstract and pp. 384-386 (China Academic Journal Electronic Publishing House, 2007).

English translation of Office Action from corresponding Chinese Patent Application No. 200880130132.9, dated Aug. 31, 2012.

Office Action in corresponding JP Application No. 2010-518845, dated Sep. 25, 2012.

European Search Report in corresponding European Application No. 08777724.9, dated Feb. 19, 2015.

European Search Report in corresponding European Application No. 08777724.9, dated Oct. 20, 2015.

* cited by examiner

M
20
40
50
41
51
LUBRICATING OIL
GAS
62a
10
60
60
100
W
62
62b
61
61
62b
62
62a
W
30
B

GAS PRESSURE CONTROLLED CASTING MOLD

TECHNICAL FIELD

The present invention relates to a gas pressure controlled casting mold suitable for semi-continuous or continuous casting of a non-ferrous metal such as aluminum or an aluminum alloy.

BACKGROUND

Conventionally, as a casting process of a non-ferrous metal such as aluminum or an aluminum alloy, a non-ferrous metal manufacturing industry has widely used, for example, a casting process by a so-called gas pressurized hot-top casting mold as disclosed in the Patent Document 1 (JP 54-042847 A) and Patent Document 2 (JP 63-154244 A) below. According to the gas pressurized hot-top casting mold, for example, as illustrated in FIGS. 10 and 11, a molten metal M of aluminum coming out of a hot-top 20 made of a refractory heat-insulating material is directly passed to a passage portion 30 formed in a mold (die) body 10 and at the same time, the molten metal M is forcibly cooled by cooling water W blown out of the mold body 10 to be continuously solidified into a rod-shaped billet B.

As illustrated in FIG. 11, a lubricating oil blow-out hole 40 and a gas passage hole 50 are provided on the upper end of the wall surface of the molten metal passage portion 30 of the mold body 10. When the molten metal M passes through the molten metal passage portion 30, lubricating oil and gases such as inactive gases and air are blown in from the lubricating oil blow-out hole 40 and the gas passage hole 50. This allows the molten metal M to smoothly pass (cast) through the molten metal passage portion 30 with less contact and friction of an inner surface thereof, which can smooth the surface shape of the billet B.

By the way, as illustrated in FIG. 11, the mold for implementing the gas pressurized hot-top continuous casting process includes a refrigerant passage 60 in the mold body 10 so as to forcibly cool the entire mold by the refrigerant (cooling water) W flowing through the refrigerant passage 60. However, according to the conventional mold, the deep annular grooves 70 for supplying a lubricating oil and a gas are annularly formed along the molten metal passage portion 30 of the mold between the refrigerant passage 60 and the lubricating oil blow-out hole 40 and the gas passage hole 50. These grooves 70 act as a heat-insulating layer, thereby preventing the portions of the lubricating oil blow-out hole 40 or the gas passage hole 50 from being cooled sufficiently. Moreover, since the refrigerant passage 60 in the mold body 10 is formed into a rectangular shape in the cross section as illustrated, a part of the refrigerant W flowing through the refrigerant passage 60 is retained at corner portions thereof, thereby preventing effective cooling of the upper portion of the molten metal passage portion 30, which requires heat exchange for solidification.

For this reason, when the temperature of the mold body 10 rises with casting of an alloy with a high molten metal pouring temperature or with a high casting speed, the molten metal cooling capability of the mold reduces, and the surface of the billet B may be in a state of a so-called gas skin. Further, the lubricating effect between the molten metal M and the molten metal passage portion 30 reduces, and the friction between the molten metal passage portion 30 and the molten metal M increases. As a result, the solidified metals and oxides are attached to the surface of the molten metal passage portion 30 and the surface of the billet B tends to be susceptible to a casting defect called shrinking.

Further, since a reduced cooling capability of the mold body 10 reduces the strength of a solidified shell generated from the molten metal M by cooling the mold body 10, as a result, the solidified shell cannot withstand the friction with the molten metal passage portion 30. This causes a problem in that the solidified shell is damaged to be broken out, thereby preventing casting. As illustrated in FIG. 11, after the lubricating oil and the gas supplied from the lubricating oil blow-out hole 40 or the gas passage hole 50 to the molten metal passage portion 30 reach the meniscus portion space S, with the passage of the molten metal M, they advance along the wall surface of the molten metal passage portion 30 and pass downward of the molten metal passage portion 30.

At this time, as the temperature of the mold body 10 rises, a stress from the lubricating oil expansion of the annular lubricating oil supply groove 70 and the thermal expansion of the mold body 10 causes an excess supply of lubricating oil, which is blown out over the molten metal M. Then, the lubricating oil is gasified to cause an excess supply of pressurized gas. The change of the pressurized condition by gas may cause an excessive change of a space (meniscus portion space) S formed between the upper portion of the molten metal passage portion 30, the hot-top 20, and the molten metal meniscus portion m, thereby deteriorating the quality of the billet B.

More specifically, when the gas pressure inside the meniscus portion space S exceeds the molten metal pressure due to the gasification of the lubricating oil, the meniscus portion space S is enlarged and there may occur a phenomenon (bubbling) where a gas and a gasified lubricating oil in the meniscus portion space S escape from the molten metal passage portion 30 to the hot-top 20 side. When such a bubbling occurs, the oxide inclusions or films are generated, which are caught in the surface layer portion of the billet B, thereby causing a surface defect or internal defect of the billet.

If such a defect remains in the final product, the mechanical characteristics of the product are reduced, a forging crack defect at forging occurs, or a visual defect in alumite occurs. Further, if such a bubbling occurs, the meniscus portion space S vanishes momentarily, and the molten metal M may be stuck in the lubricating oil blow-out hole 40 and the gas passage hole 50, where the molten metal M may be solidified or fixed so as to block the holes. As a result, since the meniscus portion space S is not formed later, a big cast skin defect may occur, thereby causing a billet defect.

SUMMARY

Accordingly, the present invention has been made to effectively solve the above problems. Its main object is to provide a new gas pressure controlled casting mold which can reliably cool the entire mold (especially the upper portion of the mold) for continuous casting regardless of the difference in the temperature and casting speed conditions.

A first embodiment disclosed herein is a gas pressure controlled casting mold comprising a hot-top introducing a molten metal of aluminum or aluminum alloy; and a mold body which passes the molten metal of aluminum or aluminum alloy introduced from the hot-top through a molten metal passage portion for cooling and solidification and semi-continuously or continuously casts a billet of aluminum or aluminum alloy, wherein a wall surface of the molten metal passage portion of the mold body is provided with a plurality of lubricating oil blow-out holes for blowing out a lubricating oil, and a lubricating oil supply passage communicatively connected to the each lubricating oil blow-out hole is independently formed at least in a range of a heat affected portion in the mold body.

A second embodiment disclosed herein is a gas pressure controlled casting mold comprising a hot-top introducing a molten metal of aluminum or aluminum alloy; and a mold body which passes the molten metal of aluminum or aluminum alloy introduced from the hot-top through a molten metal passage portion for cooling and solidification and semi-continuously or continuously casts a billet of aluminum or aluminum alloy, wherein a wall surface of the molten metal passage portion of the mold body is provided with a plurality of gas passage holes for passing a gas, and a gas passage communicatively connected to the each gas passage hole is independently formed at least in a range of a heat affected portion in the mold body.

A third embodiment disclosed herein is a gas pressure controlled casting mold comprising a hot-top introducing a molten metal of aluminum or aluminum alloy; and a mold body which passes the molten metal of aluminum or aluminum alloy introduced from the hot-top through a molten metal passage portion for cooling and solidification and semi-continuously or continuously casts a billet of aluminum or aluminum alloy, wherein a wall surface of the molten metal passage portion of the mold body is provided with a plurality of lubricating oil blow-out holes for blowing out a lubricating oil and a plurality of gas passage holes for passing a gas; and a lubricating oil supply passage and a gas passage communicatively connected to the each lubricating oil blow-out hole and gas passage hole respectively are independently formed at least in a range of a heat affected portion in the mold body.

According to the first to third embodiments in accordance with the present invention, one or both of the lubricating oil supply passage and the gas passage are independently formed at least in a range of a heat affected portion in the mold body, and the cross section area of the lubricating oil supply passage and the gas passage located between the refrigerant passage incorporated in the mold body and the molten metal passage portion are greatly reduced, thereby preventing a reduction in thermal conductivity of the mold body due to the presence of the lubricating oil supply passage and the gas passage. In particular, it is possible to more reliably cool near the lubricating oil blow-out hole and the gas passage hole. This stabilizes the pressurized condition of the gas blown out from the gas passage hole and thus can minimizing a variation of the meniscus portion space. Further, this can suppress an increase in temperature of the lubricating oil so that the amount of vaporized lubricating oil can be reduced and the original lubricating capability of the lubricating oil can be exerted.

As a result, since a further increase in casting speed is not accompanied by an increase in temperature of the mold body, a decrease in quality of the product or a casting defect can be suppressed and the higher temperature and speed than conventional casting can be realized. At the same time, since the heat affected portion of the mold body does not have a lubricating oil supply groove or a gas pressure control groove, a variation of the amount of lubricating oil supply and a variation of the amount of pressurized gas are reduced due to a deformation of the mold body, and the stable quality of a product can be maintained. Here, as illustrated in the subsequent embodiments, "heat affected portion in the mold body" called in the present invention refers to a portion directly affected by heat of a molten aluminum passing through a molten metal passage portion in the mold body, namely, a portion including a region at least ranging from a wall surface of the molten metal passage portion contacted by a molten aluminum to the refrigerant passage close to the wall surface of the molten metal passage portion in the mold body.

A fourth embodiment disclosed herein is a gas pressure controlled casting mold according to the first to third embodiments, detachably providing a ring plate substantially concentric with the molten metal passage portion on an upper surface of the mold body, and providing, on the ring plate, any one or more holes of the lubricating oil blow-out hole, the gas passage hole, and the pressure measurement communication hole for measuring a pressure of a meniscus portion space formed between the upper end of the mold body, the hot-top, and the molten metal meniscus portion.

According to the fourth embodiment, the lubricating oil blow-out holes, the gas passage holes or the pressure measurement communication holes can be shaped and formed in a relatively easy manner. Moreover, when a corner portion in contact with the hot-top is damaged by grinding, denting, or the like of the mold body, or when a cast skin defect is easily formed due to any of the lubricating oil blow-out hole and the gas passage hole being deformed by bubbling or the like, such problems can be easily solved simply by only replacing the ring plate with a new one or cleaning the ring plate.

A fifth embodiment disclosed herein is a gas pressure controlled casting mold according to the fourth embodiment, any one or both of the mold body and the ring plate are formed of copper or copper alloy. According to the fifth embodiment, since any one or both of the mold body and the ring plate are made of copper or copper alloy, which is a metal excellent in thermal conductivity, the mold body and the ring plate can be effectively cooled by a refrigerant flowing through the refrigerant passage.

A sixth embodiment disclosed herein is a gas pressure controlled casting mold according to the first to third embodiments, wherein a refrigerant passage is formed in the mold body. At a lower end of the molten metal passage portion, a blow-out hole or a blow-out slit is formed for blowing out a refrigerant, flowing through the refrigerant passage, toward a solidified shell of aluminum or aluminum alloy continuously formed by the molten metal passage portion of the mold body. Connecting between the blow-out hole or the blow-out slit for the refrigerant and the refrigerant passage in the mold body is a communication path near the molten metal passage portion which extends downward from the upper end side of the molten metal passage portion.

According to the sixth embodiment, the refrigerant inside the refrigerant passage can flow smoothly without retention toward the refrigerant blow-out hole side or the blow-out slit side. This allows a cool refrigerant to flow from the upper end of the mold body contacted by the molten metal required to be cooled. As a result, since the molten metal passage portion in the upper portion of the mold body is more cooled and the billet can be effectively cooled, a higher temperature and speed than conventional casting can be achieved.

A seventh embodiment is a gas pressure controlled casting mold comprising a hot-top introducing a molten metal of aluminum or aluminum alloy; and a mold body which passes the molten metal of aluminum or aluminum alloy introduced from the hot-top through a molten metal passage portion for cooling and semi-continuously or continuously casts a billet of aluminum or aluminum alloy; wherein a refrigerant passage is formed in the mold body; at a lower end of the molten metal passage portion, a blow-out hole or a blow-out slit is formed for blowing out a refrigerant flowing through the refrigerant passage toward a solidified shell of aluminum or aluminum alloy continuously formed by the molten metal passage portion of the mold body; and the blow-out hole or the blow-out slit for the refrigerant and the refrigerant passage in the mold body are connected by using a communication path near the molten metal passage portion which extends downward from the upper end side of the molten metal passage portion.

According to the seventh embodiment, the refrigerant in the refrigerant passage can flow smoothly without retention toward the refrigerant blow-out hole side or the blow-out slit side. This allows a cool refrigerant to flow from the upper end of the mold body contacted by the molten metal required to be cooled. As a result, since the molten metal passage portion in the upper portion of the mold body is more cooled and the billet can be effectively cooled, a higher temperature and speed than conventional casting are realized.

An eighth embodiment is a gas pressure controlled casting mold according to the first to third embodiments having a refrigerant passage formed in the mold body. At a lower end of the molten metal passage portion, a blow-out hole or a blow-out slit is formed for blowing out a refrigerant flowing through the refrigerant passage toward a solidified shell of aluminum or aluminum alloy continuously formed by the molten metal passage portion of the mold body; and the blow-out hole or the blow-out slit for the refrigerant and the refrigerant passage in the mold body are connected by using a vertical communication path near the molten metal passage portion which extends downward from the upper end side of the molten metal passage portion and a horizontal communication path directly under the gas passage or the lubricating oil supply passage which extends inward in a substantially horizontal direction.

According to the eighth embodiment, since the vertical communication path and the horizontal communication path are used to connect between the blow-out hole or the blow-out slit for the refrigerant and the refrigerant passage in the mold body, the refrigerant in the refrigerant passage can flow smoothly without retention toward the refrigerant blow-out hole side or the blow-out slit side. Further, since a cool refrigerant in the refrigerant passage flows to the vertical communication path through the horizontal communication path, the lubricating oil supply passage and the gas passage located close to the horizontal communication path can also be effectively cooled. This allows the lubricating oil passing through the lubricating oil supply passage and the gas passing through the gas passage to be prevented from being excessively heated.

A ninth embodiment is a gas pressure controlled casting mold comprising a hot-top introducing a molten metal of aluminum or aluminum alloy; and a mold body which passes the molten metal of aluminum or aluminum alloy introduced from the hot-top through a molten metal passage portion for cooling and solidification and semi-continuously or continuously casts a billet of aluminum or aluminum alloy; wherein a refrigerant passage is formed in the mold body. At a lower end of the molten metal passage portion, a blow-out hole or a blow-out slit is formed for blowing out a refrigerant flowing through the refrigerant passage toward a solidified shell of aluminum or aluminum alloy continuously formed by the molten metal passage portion of the mold body; and the blow-out hole or the blow-out slit for the refrigerant and the refrigerant passage in the mold body are connected by using a vertical communication path near the molten metal passage portion which extends downward from the upper end side of the molten metal passage portion and a horizontal communication path directly under the gas passage or the lubricating oil supply passage which extends inward in a substantially horizontal direction.

According to the ninth embodiment, since the vertical communication path and the horizontal communication path are used to connect between the blow-out hole or the blow-out slit for the refrigerant and the refrigerant passage in the mold body, the refrigerant in the refrigerant passage can flow smoothly without retention toward the refrigerant blow-out hole side or the blow-out slit side. Further, since a cool refrigerant inside the refrigerant passage flows to the vertical communication path through the horizontal communication path, the lubricating oil supply passage and the gas passage located close to the horizontal communication path can also be effectively cooled. This allows the lubricating oil passing through the lubricating oil supply passage and the gas passing through the gas passage to be prevented from being excessively heated.

A tenth embodiment is a gas pressure controlled casting mold according to the first, third, seventh and ninth embodiments comprising a communication hole formed for pressure measurement in the mold body; wherein a pressure measurement means for measuring a pressure of the meniscus portion space formed between the upper end of the mold body, the hot-top, and the molten metal meniscus portion is provided on the communication hole; and at the gas passage or the lubricating oil supply passage, a pressure control means is provided for controlling a pressure of the meniscus portion space based on a measured value by the pressure measurement means.

According to the tenth embodiment, since the pressure measurement means for measuring a pressure of the meniscus portion space and the pressure control means for controlling a pressure thereof are provided, the shape of the molten metal meniscus portion can be optimally controlled and stabilized by a pressure condition. Further, since the pressure condition can also be changed to change the shape of the molten metal meniscus portion and a foreign object and the like adhered to the wall surface of the molten metal passage portion can be attached to a cast skin to be removed, a defect such as a comet tail can be prevented from occurring. This enables a continuous casting for a long time. Further, a phenomenon inviting a cast defect such as a bubbling can be reliably prevented.

An eleventh embodiment is a gas pressure controlled casting mold according to the tenth embodiment, wherein the pressure control means regulates an amount of lubricating oil supply supplied from the lubricating oil supply passage and controls the pressure of the meniscus portion space. According to the eleventh embodiment, even for casting an alloy which is difficult to maintain the meniscus portion space because the casting speed is increased or because the gas does not pass through downward along the wall surface of the molten metal passage portion, since the meniscus portion space can be stably maintained, a reduction in quality, a cast defect, and the like are suppressed.

A twelfth embodiment is a gas pressure controlled casting mold according to the tenth embodiment, wherein the pressure control means controls the pressure of the meniscus portion space by increasing or decreasing a gas pressure in the gas passage. According to the twelfth embodiment, even for casting an alloy which is difficult to maintain the meniscus portion space because the gas does not pass through downward along the liquid surface of the molten metal passage portion, since the meniscus portion space can be stably maintained, a reduction in quality, a cast defect, and the like are suppressed.

A thirteenth embodiment is a gas pressure controlled casting mold according to the seventh to ninth embodiments, wherein the communication hole for pressure measurement formed in the gas passage or the mold body is provided with a trap mechanism for trapping a lubricating oil flowing back from the meniscus portion space. According to the thirteenth embodiment, when the gas pressure of the meniscus portion space increases and the gas returns through the gas passage hole or the pressure measurement communication hole, and if a lubricating oil mixed with the gas enters the gas passage or the gas pressure measurement hole, the lubricating oil mixed with the gas can be trapped with the trap function. Since the lubricating oil being stuck in the gas passage hole or the pressure measurement communication hole can be prevented, the pressure control and pressure measurement can be enabled under the accurate gas pressurized conditions and stable casting is realized.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
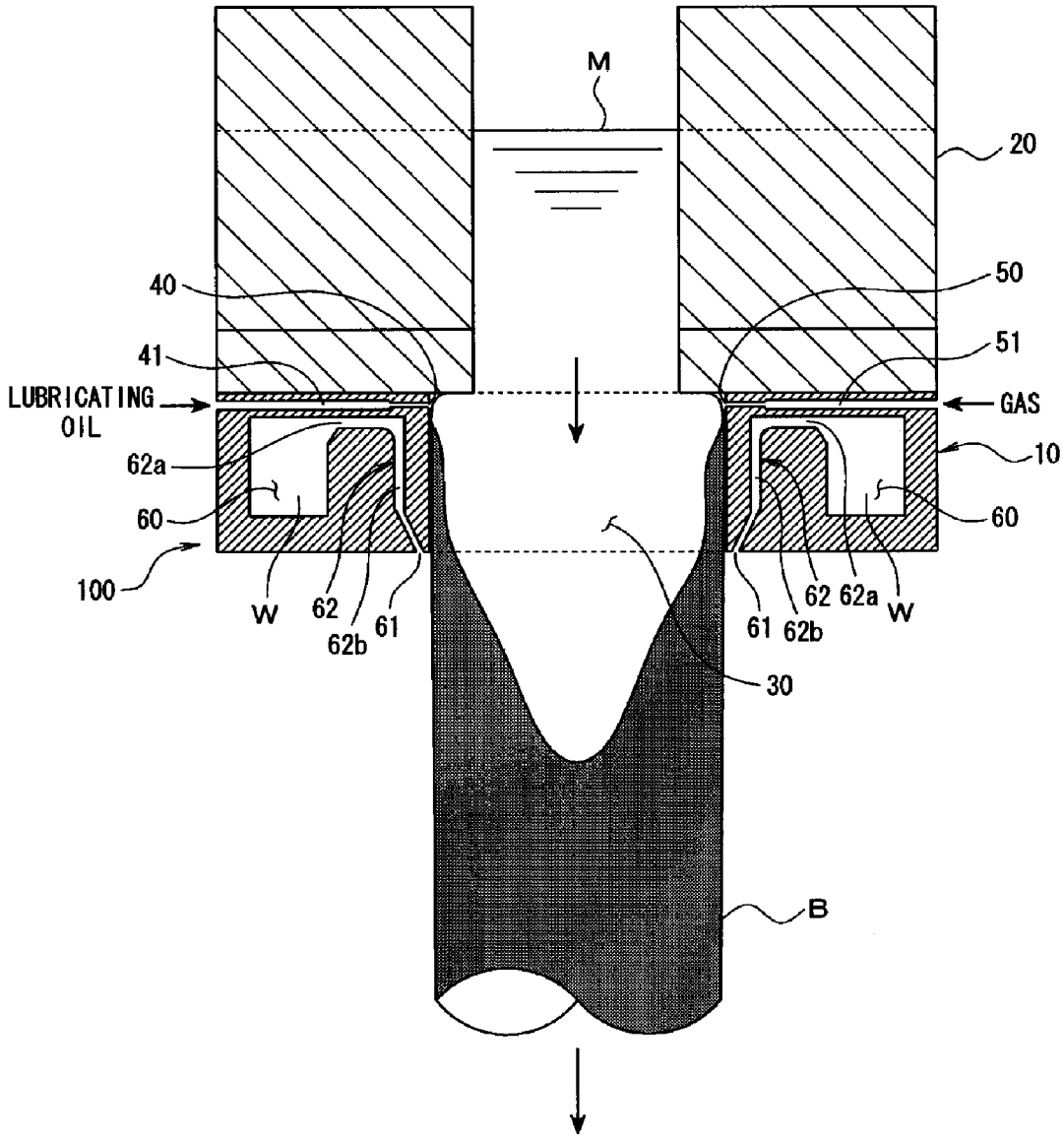
FIG. 1 is a longitudinal sectional view illustrating a first embodiment of a gas pressure controlled casting mold 100 in accordance with the present invention.

FIGS. 1 to 4 illustrate a first embodiment of the gas pressure controlled casting mold 100 in accordance with the present invention. As illustrated in the drawings, the gas pressure controlled casting mold 100 is configured to provide a hot-top 20 made of a refractory heat-insulating material above the mold body 10 made of a metal material excellent in thermal conductivity, such as aluminum or aluminum alloy, or copper or copper alloy. Further, a sectionally circular molten metal passage portion 30 is formed in a center portion of the mold body 10 so as to vertically pass therethrough.

Then, a molten metal M of aluminum or aluminum alloy introduced from the hot-top 20 is passed through the molten metal passage portion 30 of the mold body 10 for cooling and solidification. This allows a billet B of aluminum or aluminum alloy to be semi-continuously or continuously cast. Further, the mold body 10 includes an annular refrigerant passage 60 therein so as to surround the molten metal passage portion 30 in the center thereof. Then, a refrigerant (cooling water) W supplied from a refrigerant supply pump (not illustrated) is fed into the refrigerant passage 60 to cool the entire mold body 10 from inside thereof.

Further, a slit-like refrigerant blow-out hole 61 extending along the periphery of the molten metal passage portion 30 is formed in the lower end portion of the molten metal passage portion 30 of the mold body 10. The refrigerant blow-out hole 61 is communicatively connected to the refrigerant passage 60 through the communication path 62 formed in the mold body 10. Then, the refrigerant (cooling water) W flowing inside the refrigerant passage 60 is blown out from the refrigerant blow-out hole 61, and the blown out refrigerant W is blown over the surface of a solidified shell formed by cooling by the mold body 10 and the surface of the billet B formed of the molten metal M. This allows the billet B to be forcibly cooled so as to solidify the remaining molten metal M in the solidified shell.

Here, the communication path 62 communicatively connecting the refrigerant blow-out hole 61 and the refrigerant passage 60 consists of a horizontal communication path 62*a* and a vertical communication path 62*b*. The horizontal communication path 62*a* has a shape horizontally extending in a direction of the molten metal passage portion 30 from the upper portion of the rectangular refrigerant passage 60 with respect to the cross section in the peripheral direction of the molten metal passage portion 30. On the other hand, the vertical communication path 62*b* has a structure extending vertically downward along the wall surface of the molten metal passage portion 30 from the end portion of the horizontal communication path 62*a*.

On the one hand, a plurality of (four in the present embodiment) lubricating oil blow-out holes 40 for blowing out lubricating oil such as castor oil and a plurality of (four in the present embodiment) gas passage holes 50 for passing (supplying or discharging) gasses such as inactive gases and air are formed at equal intervals at the upper end side of the wall surface of the molten metal passage portion 30. The individual lubricating oil supply passages 41, 41, 41, and 41 are connected independently to the respective lubricating oil blow-out holes 40, 40, 40, and 40 so as to pass through inside the mold body 10 from outside thereof. Further, the lubricating oil is supplied independently to the individual lubricating oil blow-out holes 40, 40, 40, and 40 from the respective lubricating oil supply passages 41, 41, 41, and 41.

Moreover, the individual gas passages 51, 51, 51, and 51 are also connected independently to the respective gas passage holes 50, 50, 50, and 50 so as to pass through inside the mold body 10 from outside thereof. Furthermore, gases are supplied independently to the respective gas passage holes 50, 50, 50, and 50 from the respective gas passages 51, 51, 51, and 51. Note that the individual lubricating oil blow-out holes 40, 40, 40, and 40 and the individual gas passage holes 50, 50, 50, and 50, as well as the individual lubricating oil supply passages 41, 41, 41, and 41, the individual gas passages 51, 51, 51, and 51 are formed by drilling with a drill of a predetermined diameter from inside and outside of the mold body 10 so as to communicatively connect to each other on an outer circumference thereof.

Figure 3:
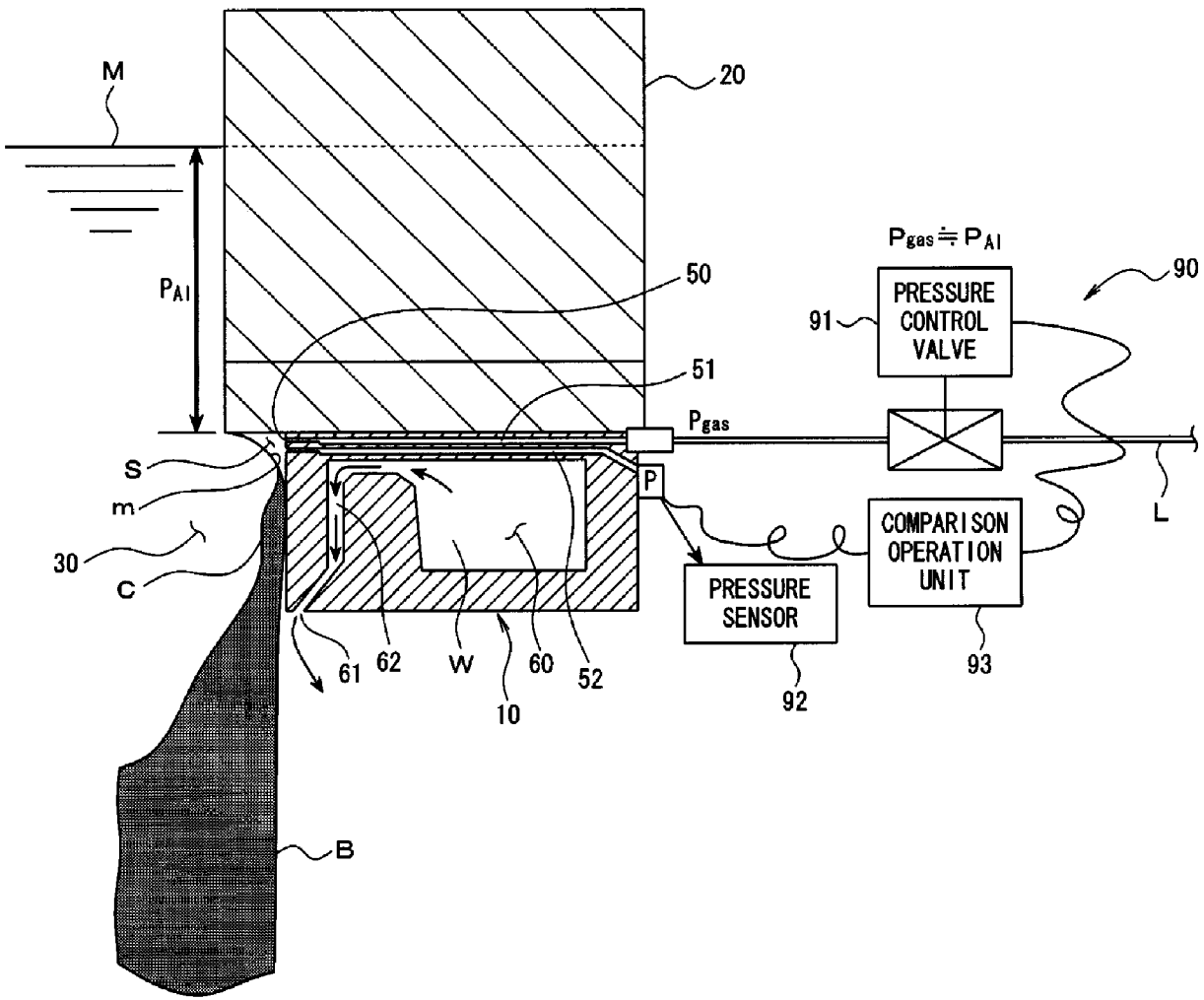
FIG. 3 is an explanatory drawing illustrating a configuration of a pressure control means 90 provided in a gas passage 51.

On the other hand, as illustrated in FIG. 3, the mold body 10 includes a pressure control means 90 for controlling a pressure $P_{gas}$ of the gas in the gas passage 51. This pressure control means 90 comprises a pressure control valve (relief valve) 91, a pressure sensor 92 (pressure measurement means), a comparison operation unit 93, and a head pressure calculation unit (not illustrated). Here, the pressure control valve (relief valve) 91 controls the gas pressure $P_{gas}$ in the gas passage 51 through the gas passage line L for passing gasses. Further, the pressure sensor 92 (pressure measurement means) is configured to detect a gas pressure of the meniscus portion space S through the pressure measurement communication hole 52 communicatively connected to the meniscus portion space S in the same manner as the gas passage 51.

Further, the comparison operation unit 93 is configured to calculate an optimal gas pressure $P_{gas}$ of the meniscus portion space S. Moreover, the un-illustrated head pressure calculation unit is configured to optically or physically detect the height of a liquid level of the molten metal M in the hot-top 20 and to calculate the head pressure $P_{Al}$ of the molten metal M. In addition, the above individual components can be used independently. In that case, the pressure control valve (relief valve) 91 is controlled so as the $P_{gas}$ becomes equal to the calculated approximate molten metal pressure in the upper portion of the meniscus portion space S. If the accurate head pressure $P_{Al}$ of the molten metal M is unknown, the pressure is raised for bubbling to detect the head pressure $P_{Al}$ wherein the pressure is controlled based on the detected pressure $P_{Al}$, for example, the pressure is controlled to a pressure which is smaller than the bubbling pressure by 10 to 30 hPa.

On the other hand, all the pressure control means 90 may be used to control with a feedback loop using the measured value of $P_{Al}$. In this case, the comparison operation unit 93 controls the pressure control valve 91 so that the head pressure $P_{Al}$ of the molten metal M calculated by the head pressure calculation unit becomes approximately equal to the pressure $P_{gas}$ of the meniscus space S detected by the pressure sensor 92 ($P_{Al} \cong P_{gas}$) in a steady state of casting. As a result, the pressure $P_{gas}$ of gas supplied from the gas passage line L is simultaneously controlled.

Moreover, at the start time and at the end time, it is advantageous to control to a low pressure so as to prevent an error such as bubbling from occurring with respect to an unstable variation of the molten metal level. Furthermore, when the cast skin starts to be rough due to the comet tail, shrinking, or the like, the position of the molten metal meniscus portion m is raised to the upper portion of the molten metal passage portion 30 by lowering the gas pressure, so that the substances causing the rough skin are removed by attaching them to a cast skin. For continuous casting, a stable cast skin can be maintained by periodically performing this operation.

Figure 2:
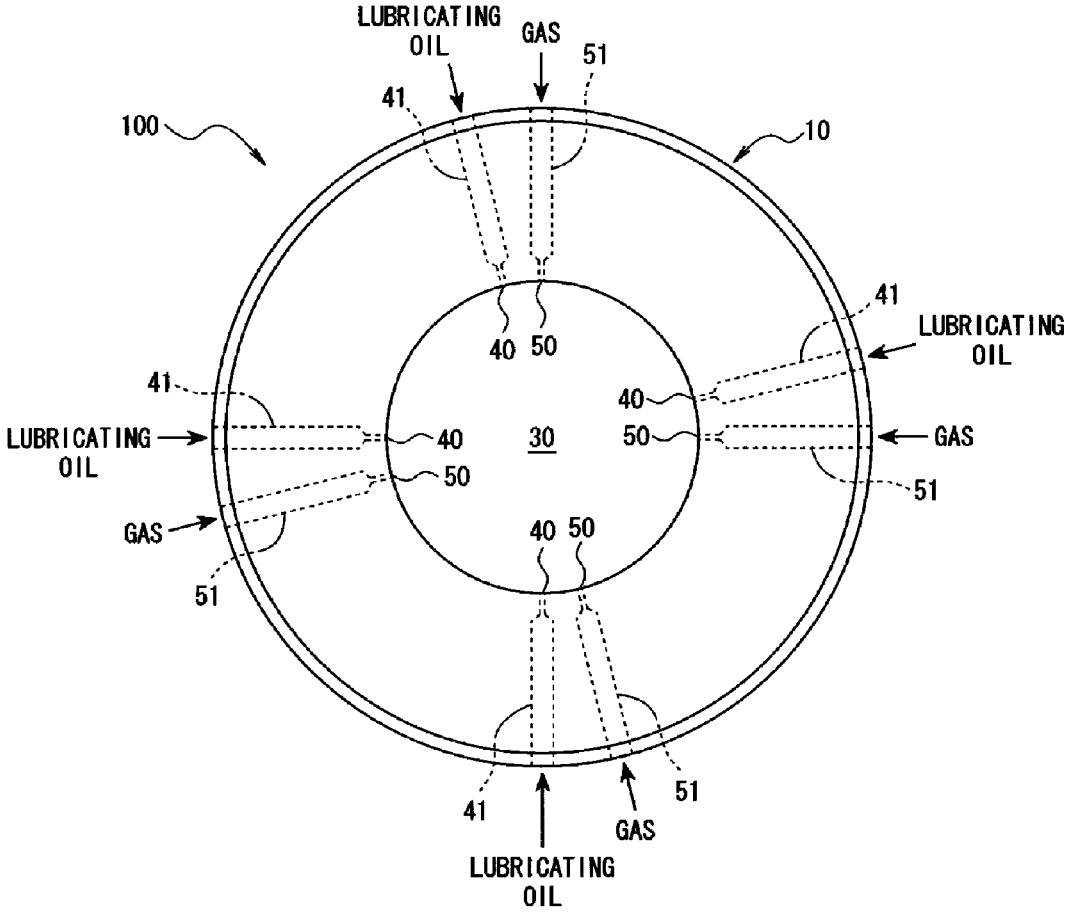
FIG. 2 is a plan view illustrating an upper surface structure of a mold body in accordance with the first embodiment.

Hereinafter, the operations and advantages of the gas pressure controlled casting mold 100 which is configured in accordance with the present invention will be described. First, as illustrated in FIGS. 1 to 3, the molten metal M of aluminum or aluminum alloy in the hot-top 20 on the upper portion of the mold body 10 is poured into the molten metal passage portion 30 of the mold body 10, and at the same time, the lubricating oil and the gas are blown out from the individual lubricating oil blow-out holes 40, 40, 40, and 40 and the individual gas passage holes 50, 50, 50, and 50. Then, the lubricating oil flows along the inner wall surface of the mold body 10, and comes in contact with the surface of the molten metal M in a lower portion of the molten metal meniscus portion m, where the partially gasified lubricating oil facilitates the generation of a solidified shell C and at the same time reduces the friction between the solidified shell C and the wall surface of the molten metal passage portion 30.

Further, the gas maintains and forms the meniscus portion space S according to the pressure thereof. When the pressure is made approximately equal to the molten metal pressure ($P_{Al} \cong P_{gas}$), the meniscus portion space S can be maximized. As a result, the contact angle between the molten metal meniscus portion m and the wall surface of the molten metal passage portion 30 can be minimized and the contact position thereof can be set to a low position of the wall surface of the molten metal passage portion 30. Moreover, a part of the gas passes through between the wall surface of the molten metal passage portion 30, and passes downward of the molten metal passage portion 30 with the solidified shell C.

As described above, the lubricating oil and the gas supplied from the lubricating oil blow-out holes 40 and the gas passage holes 50 can facilitate the generation of the solidified shell C on the surface of the molten metal M, can reduce the contact and the friction between the solidified shell C and the wall surface of the molten metal passage portion 30, can minimize the contact angle between the molten metal meniscus portion m and the wall surface of the molten metal passage portion 30, and can set the contact position thereof to a low position of the wall surface of the molten metal passage portion 30, thereby allowing the molten metal M to pass smoothly so that the surface shape of the billet B is smoothed.

Afterward, the molten metal M in contact with the wall surface of the molten metal passage portion 30 of the mold body 10 is quickly cooled by the mold body 10 and falls through inside the molten metal passage portion 30 while forming a solidified shell from outside thereof. Further, the molten metal M is forcibly cooled quickly to near water temperature by a refrigerant (cooling water) blown out from the refrigerant blow-out hole 61 at the lower end of the molten metal passage portion 30 to be solidified to the inside thereof so that a rod-shaped cast (billet B) is continuously cast.

Moreover, according to the gas pressure controlled casting mold 100 in accordance with this embodiment, the individual lubricating oil supply passages 41, 41, 41, and 41 and the individual gas passages 51, 51, 51, and 51 are connected independently to the respective lubricating oil blow-out holes 40, 40, 40, and 40 and the respective gas passage holes 50, 50, 50, and 50 in the mold body 10 only by way of radial drill holes from the inner circumference (wall surface of the molten metal passage portion 30) side of the mold body 10 to the outer circumference of the mold body 10. This can allow the lubricating oil and the gas to receive less heat from the mold body 10 and can prevent an increase in temperature of the lubricating oil and the gas.

This can stabilize the pressurized condition by the gas blown out from the gas passage holes 50, 50, 50, and 50 and can suppress the modification or vaporization of the lubricating oil in the lubricating oil supply passages 41, 41, 41, and 41 and the lubricating oil blow-out holes 40, 40, 40, and 40. Moreover, the molten metal passage portion 30 of the mold body 10 can be reliably cooled, thereby minimizing the variation of the meniscus portion space S.

As a result, this can prevent a phenomenon inviting a casting defect such as a bubbling, sticking of a molten metal M in the lubricating oil blow-out holes 40, 40, 40, and 40 or the gas passage holes 50, 50, 50, and 50, shrinking caused by an increase in the temperature of the mold body 10, and a gas skin. Further, this can suppress an increase in the temperature of the lubricating oil so that the amount of vaporized lubricating oil can be minimized and the original lubricating capability of the lubricating oil can be exerted.

As a result, even if the casting temperature or casting speed is further increased, a decrease in quality or a casting defect can be avoided, thus achieving casting at a higher temperature and speed than before. Moreover, the communication path 62 is provided near the molten metal passage portion 30 and extending downward from the upper end side of the molten metal passage portion 30 for connecting between the refrigerant blow-out hole 61 provided at the lower end of the molten metal passage portion 30 and the refrigerant passage 60. Therefore, as indicated by the arrows in FIG. 3, the refrigerant W in the refrigerant passage 60 can flow smoothly without retention toward the refrigerant blow-out hole 61 side to be blown out over the billet B.

This can effectively cool not only the portions of the lubricating oil blow-out holes 40, 40, 40, and 40 and the gas passage holes 50, 50, 50, and 50, but also the wall surface side of the molten metal passage portion 30 where the temperature tends to rise, thereby achieving casting at a higher temperature and speed. Accordingly, the use of the gas pressure controlled casting mold 100 in accordance with the present invention enables easy and reliable casting of a difficult shape like a cast rod of a different diameter and casting susceptible to a defect on the surface of the billet B, such as high-speed casting, with a cast rod of a small diameter of five inches or less, which may be difficult to cast by a conventional mold.

Further, the communication path 62 for passing the cooling water of the refrigerant passage 60 is configured with the horizontal communication path 62*a* and the vertical communication path 62*b*. This allows a low temperature refrigerant W in the refrigerant passage 60 to flow into the vertical communication path 62*b* through the horizontal communication path 62*a*, which can effectively cool both the lubricating oil supply passage 41 and the gas passage 51, which are located near the horizontal communication path 62*a*, at the same time. As a result, the lubricating oil passing through the lubricating oil supply passage 41 and the gas passing through the gas passage 51 can be prevented from being excessively heated.

Further, as illustrated in FIG. 3, the gas passage 51 of the mold body 10 is provided with the pressure control means 90 for controlling the gas pressure $P_{gas}$, which can appropriately control the pressure of the gas supplied from the gas passage line L. This allows the size of the meniscus portion space S formed on the upper end of the molten metal passage portion 30 to be controlled so that the meniscus portion space S becomes always constant, which can more reliably prevent a phenomenon causing a cast defect such as a bubbling phenomenon ($P_{Al} \cong P_{gas}$) which occurs when the gas pressure $P_{gas}$ exceeds the head pressure $P_{Al}$.

It should be noted that the present embodiment shows an example of alternately arranging each of the four lubricating oil blow-out holes 40 (lubricating oil supply passages 41) and four gas passage holes 50 (gas passages 51) respectively, but the present invention is not limited to the present embodiment and the number of holes (passages) may be increased or decreased as needed. Further, as illustrated in FIG. 4, a trap mechanism 56 for trapping the lubricating oil poured into the gas passage 51 is desirably additionally provided to the gas passage 51 formed in the mold body 10.

That is, as described above, the present invention is configured such that each gas passage 51 is connected independently to each gas passage hole 50 respectively. Therefore, when the gas pressure is lowered to raise the molten metal meniscus portion m, or when a part of the lubricating oil blown out from the lubricating oil blow-out hole 40 is vaporized to raise the gas pressure of the meniscus portion space S, the gas in the meniscus portion space S flows back into the gas passage 51 from the gas passage hole 50.

At this time, the lubricating oil adhered to the wall surface of the molten metal passage portion 30 and the lubricating oil components vaporized in the meniscus portion space S are poured back with the gas into the gas passage 51 from the gas passage hole 50 and then may be stuck in the gas passage 51. In order to prevent this, as illustrated in FIG. 4, the gas passage 51 is desirably provided with the trap mechanism 56 for trapping the lubricating oil poured back into the gas passage 51.

Figure 4:
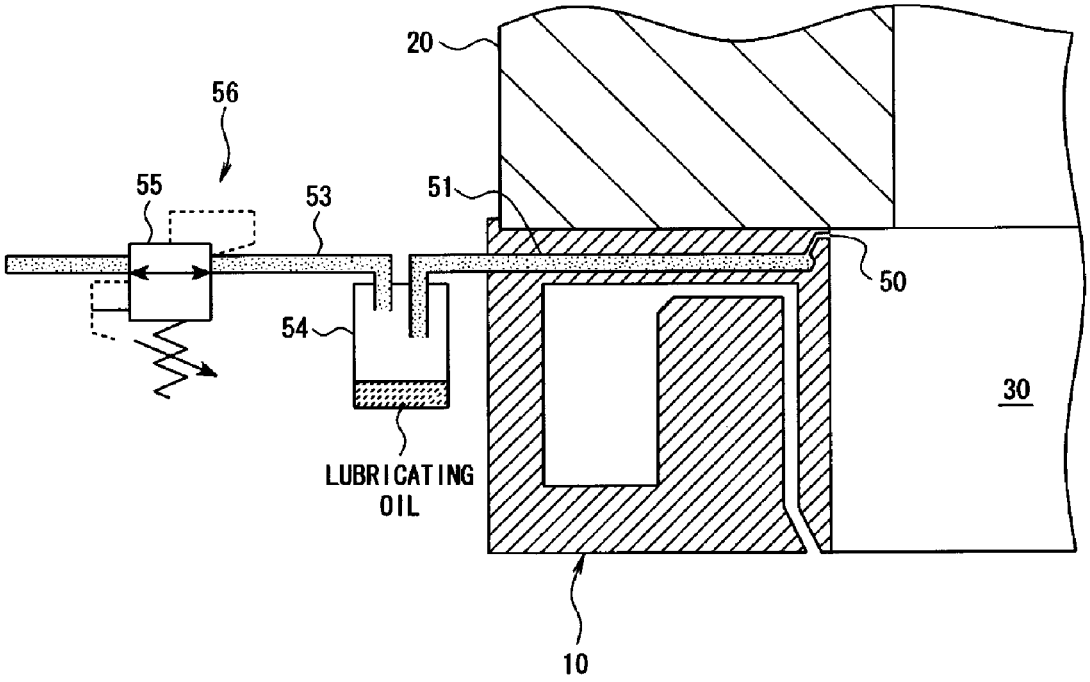
FIG. 4 is an explanatory drawing illustrating a configuration of a trap mechanism 56 which can be attached to the gas passage 51.

The trap mechanism 56 is not limited to a particular configuration, but for example, as illustrated in FIG. 4, the trap mechanism 56 may be configured such that a drain pipe 53 for discharging the lubricating oil is connected to the gas passage 51, and a trap 54 made of a closed container and a pressure reducing valve 55 with a relief (safety valve) are provided in the middle of the drain pipe 53. When such a trap mechanism 56 is provided, the lubricating oil poured into the gas passage 51 can be recovered in the trap 54 for trapping and removing, thereby reliably preventing the blockage of the gas passage 51.

It should be noted that the lubricating oil recovered in the trap 54 can be surely re-used as the lubricating oil again. Further, since the pressure reducing valve 55 with a relief (safety valve) is provided, the pressure in the gas passage 51 can be maintained at a predetermined pressure or higher, thereby enabling pressure control under accurate gas pressurized conditions and enabling stable casting. Further, such a lubricating oil flowing back phenomenon may occur not only in the gas passage 51, but also in the pressure measurement communication hole 52. Therefore, if the pressure measurement communication hole 52 is also provided with a trap mechanism 56 in the same manner, the lubricating oil poured into the pressure measurement communication hole 52 can be reliably recovered, thereby preventing the blockage of the communication hole 52. This enables pressure measurement under the accurate gas pressurized conditions.

Next, FIGS. 5 to 8 illustrate a second embodiment of the gas pressure controlled casting mold 100 in accordance with the present invention. According to the present embodiment, as illustrated in the drawings, a ring plate 80 substantially concentric with the molten metal passage portion 30 is detachably provided on the upper surface of the mold body 10. Then, the aforementioned lubricating oil blow-out hole 40 and the gas passage hole 50 are formed on the ring plate 80. Further, the each lubricating oil supply passage 41 and the individual gas passage 51 are connected independently to the respective lubricating oil blow-out hole 40 and the respective gas passage hole 50 formed on the ring plate 80.

Figure 6:
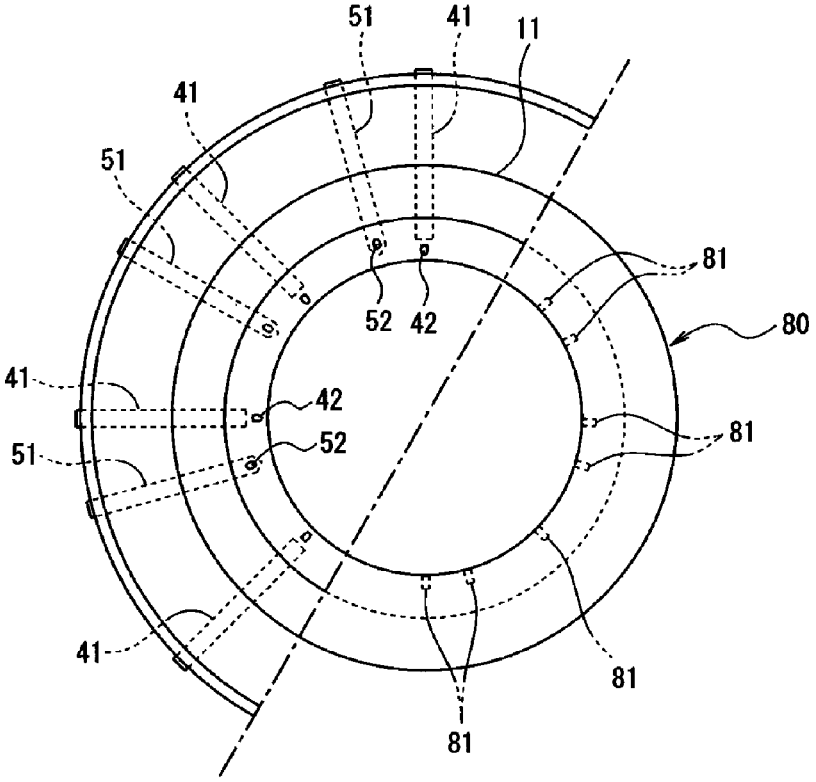
FIG. 6 is a plan view illustrating an upper surface structure of the mold body 10 in accordance with the second embodiment.
Figure 7:
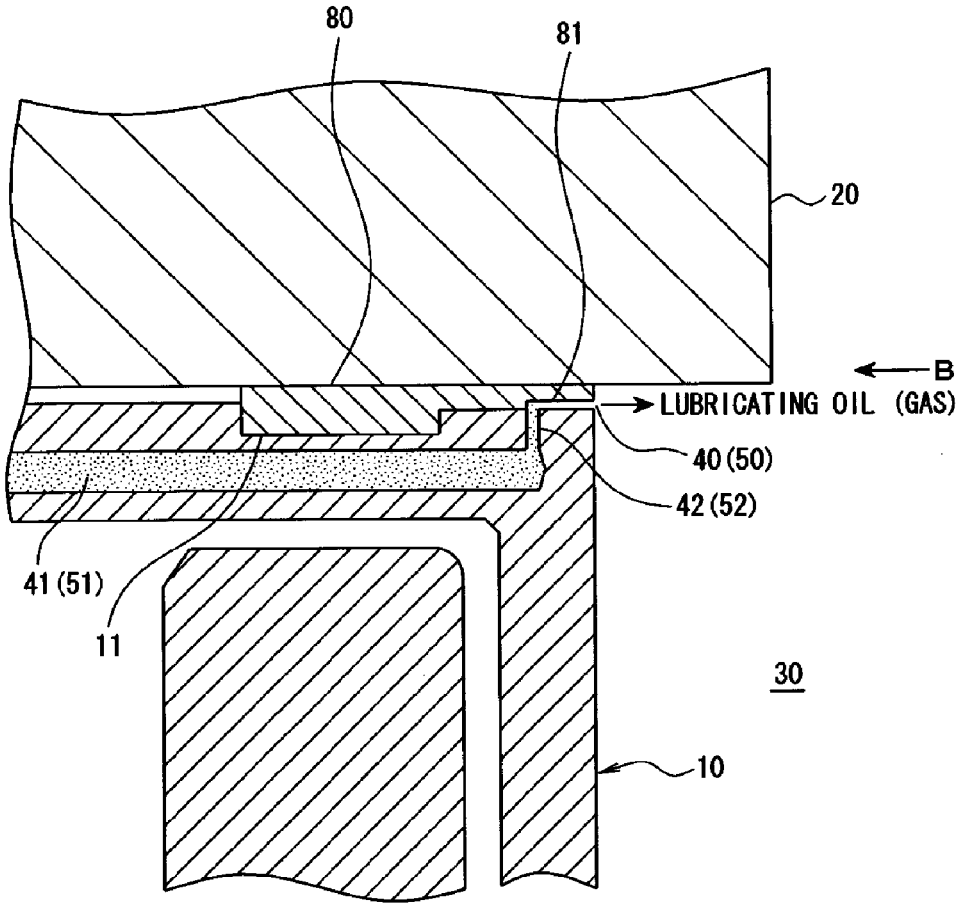
FIG. 7 is a partially enlarged view illustrating the portion A in FIG. 5.
Figure 8:
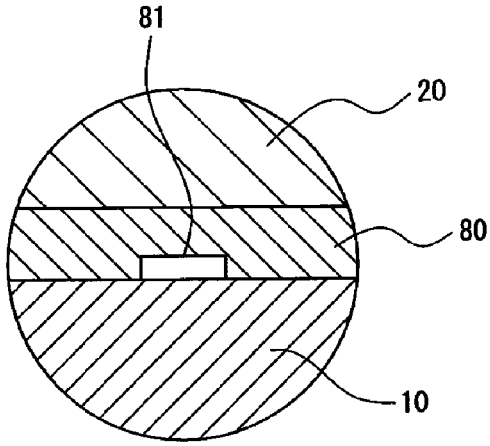
FIG. 8 is a view as viewed from the arrow B direction of FIG. 7.

That is, the ring plate 80 is detachably provided on the upper surface of the mold body 10 so as to be fitted into the annular groove portion 11 formed along the periphery of the molten metal passage portion 30. As illustrated in FIGS. 6 to 8, a plurality of sectionally rectangular groove portions 81 are formed on the inner circumference side of the under surface of the ring plate 80 so as to pass through radially inner side from the middle thereof. The individual groove portion 81, 81, . . . serve as the aforementioned respective lubricating oil blow-out holes 40 and gas passage holes 50, and the each lubricating oil supply passage 41 and each gas passage 51 are connected independently to each respective groove portions 81, 81, . . . .

More specifically, as illustrated in FIG. 7, a communication hole 42 (52) extending upward is provided on the front end side of the lubricating oil supply passage 41 and the gas passage 51 formed on the mold body 10. Then, the lubricating oil blow-out hole 40 and the gas passage hole 50 are communicatively connected to each other through the communication hole 42 (52) so as to supply the lubricating oil and the gas to the lubricating oil blow-out hole 40 and the gas passage hole 50 respectively.

According to the present embodiment, the lubricating oil blow-out hole 40 and the gas passage hole 50 are formed on the ring plate 80 detachably provided on the mold body 10, so that the lubricating oil blow-out hole 40 and the gas passage hole 50 can be processed and formed in a relatively easy manner. Moreover, when a corner portion in contact with the hot-top 20 is damaged by grinding the mold body 10, denting the mold body 10, or the like, or when any of the lubricating oil blow-out hole and the gas hole is deformed by bubbling or the like which tends to be susceptible to a skin defect, or when any of the lubricating oil blow-out hole 40 and the gas passage hole 50 is blocked or narrowed by the molten metal M stuck therein, such a problem can be easily solved simply by only replacing the ring plate 80 with a new one or cleaning the ring plate 80.

Further, when the size of the lubricating oil blow-out hole 40 and the gas passage hole 50 is desired to be changed, by simply replacing only the ring plate 80 with a new one, a new casting condition is quickly and easily adapted. Moreover, when the ring plate 80 is made of copper or copper alloy excellent in thermal conductivity, the ring plate 80 can be effectively cooled by a refrigerant flowing through the refrigerant passage 60 in the same manner as the mold body 10. It should be noted that in FIGS. 5 to 8, only the lubricating oil supply passage 41 and the gas passage 51 are formed on the ring plate 80, but the pressure measurement communication hole 52 for attaching the aforementioned pressure measurement means 92 may be collectively formed further on the ring plate 80.

Figure 9:
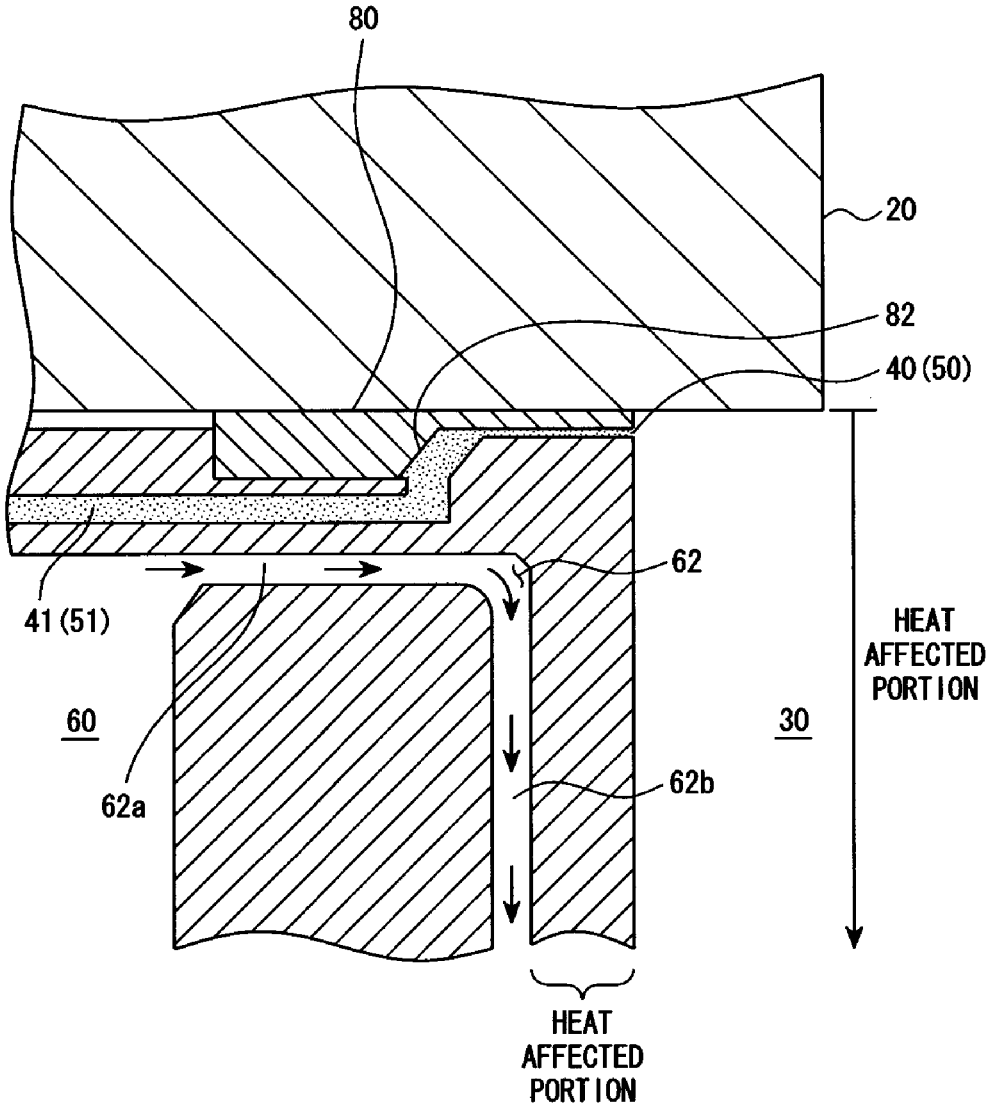
FIG. 9 is a longitudinal sectional view illustrating an example of providing an annular groove 82 in a position avoiding a heat affected portion of the mold body 10.

Next, FIG. 9 illustrates a third embodiment of the gas pressure controlled casting mold 100 in accordance with the present invention. As illustrated in the drawing, according to the present embodiment, an annular groove 82 is formed in a portion avoiding a heat affected portion near the inner wall of the mold body 10 so as to pass the lubricating oil and the gas through the annular groove 82. That is, as described above, according to the conventional mold, a deep annular groove 70 for supplying the lubricating oil and the gas is provided in the heat affected portion which is a region ranging from near the refrigerant passage 60 inside the mold body 10 to the wall surface of the molten metal passage portion 30. For this reason, the groove 70 acts as a heat-insulating layer, thereby preventing the portions of the lubricating oil blow-out hole 40 and the gas passage hole 50 from being cooled sufficiently.

For this reason, according to the aforementioned embodiments, each lubricating oil supply passage 41 and each gas passage 51 are connected independently to the respective lubricating oil blow-out hole 40 and the respective gas passage hole 50 so as to eliminate the annular groove 70 located in the heat affected portion. However, if there is no such annular groove 70 at least in the heat affected portion, the aforementioned operations and advantages can be obtained.

Therefore, as illustrated in FIG. 9, the present embodiment is configured such that the annular groove 82 is provided on an inner circumference side of the under surface of the ring plate 80 and on an outer circumference side of the heat affected portion in the mold body 10, more particularly, a region ranging from the vertical communication path 62*b* to the wall surface of the molten metal passage portion 30 where the aforementioned lubricating oil blow-out holes 40 and the gas passage holes 50 are formed, and the each lubricating oil blow-out hole 40 and each gas passage hole 50 are directly connected to the annular groove 82.

Therefore, the number of lubricating oil supply passages 41 and gas passages 51 can be greatly reduced compared to the number of lubricating oil blow-out holes 40 and gas passage holes 50, thereby facilitating the manufacturing of the mold body 10. In particular, if the place forming the lubricating oil supply passages 41 and the gas passages 51 is restricted by the shape or installation position of the mold body 10, such structure is advantageous.

Further, the actual forming position and the sectional shape of the annular groove 82 differ depending on the size of the mold, the casting speed, and the like, but for example, as illustrated in FIG. 9, if the forming position on an outer circumference side of the vertical communication path 62*b* where the cooling water W flows vertically, and if the sectional shape directed obliquely upward from the outside of the mold body 10 toward the molten metal passage portion 30 side, the heat affected portion in the mold body 10 can be avoided and the smooth flow of the gas and the lubricating oil can be achieved. It should be noted that the example of the drawing illustrates the annular groove 82 for inflow of any one of the lubricating oil and the gas, but obviously another annular groove for inflow of the other one may be provided on an outer circumference thereof, namely, in a position avoiding the heat affected portion.

EXAMPLES

Hereinafter, exemplary embodiments of the present invention will be specifically described.

First Example

As illustrated in FIG. 1, the mold 100 having the lubricating oil blow-out hole 40 as is and eliminating the gas passage hole 50 is used to cast a billet of A390 aluminum alloy under the conditions of a molten metal temperature of 800° C., a molten metal height of 10 cm, a casting speed of 400 mm/min, and castor oil used as the lubricating oil at 0.18 cc/min from the start of casting until reaching 200 mm and later 0.36 cc/min. Note that the mold 100 includes a molten metal passage portion 30 having an internal diameter of 100 mmϕ at the upper portion thereof and an internal diameter of 101 mmϕ at the lower portion thereof, and four lubricating oil blow-out holes 40 provided at equal intervals with a diameter of 0.3 mmϕ at the upper ends of the wall surface of the molten metal passage portion 30.

As a result, from the start of casting until reaching 100 mm, a ripple skin continues, but after 100 mm, a periodical fluctuation between a ripple skin and a smooth skin occurs, and later, only the smooth skin occurs. Occasionally, there continues a state in which an aluminum oxide film of molten metal meniscus m is flowing. This state indicates that the molten metal meniscus m is stable and has a large curvature thereof. Thus, there obtains a state in which the gas pressure of the molten metal meniscus m is in an appropriate state. After casting, when the surface of the billet B is observed, there obtains a billet B having a smooth skin and a striped pattern of a width of 3 to 5 mm. Further, when facing in a depth of 5 mm from the surface is performed on the billet B to check for any internal defect with a stereomicroscope, a favorable internal quality is obtained wherein the ripples, inclusions, oxide films, or blowholes were not detected.

Second Example

The mold 100 configured as illustrated in FIG. 1 is used to cast a billet B of 6061 aluminum alloy under the condition of a molten metal temperature of 700° C., a molten metal height of 22 cm, the gas pressure controlled at the atmospheric pressure plus 50 hPa, castor oil used as the lubricating oil at 0.18 cc/min, and casting speeds of 350 mm/min, 600 mm/min, and 900 mm/min. Note that the mold 100 includes a molten metal passage portion 30 having an internal diameter of 80 mmϕ at the upper portion thereof and an internal diameter of 81 mmϕ at the lower portion thereof, and four lubricating oil blow-out holes 40 and four gas passage holes 50 each provided at equal intervals with a diameter of 0.3 mmϕ and 0.2 mmϕ respectively at the upper ends of the wall surface of the molten metal passage portion 30.

When the surface state of each billet B obtained by the mold 100 is visually checked, a ripple of a large width of 2 to 3 mm is observed at the casting speed of 350 mm/min, but when the casting speed is increased to 600 mm/min, the ripple becomes small and smooth, and the ripple width becomes smaller to as much as 1 to 2 mm. Further, even when the casting speed is increased to 900 mm/min, a smooth skin is maintained and each billet B having a favorable skin with unobserved ripples is obtained. Moreover, when facing in a depth of 2 mm from the surface is performed on the billets B under the above three conditions to check for any internal defect with a stereomicroscope, the defects of ripples, inclusions, oxide films, and blowholes were not detected from any of the billets B.

Third Example

Figure 5:
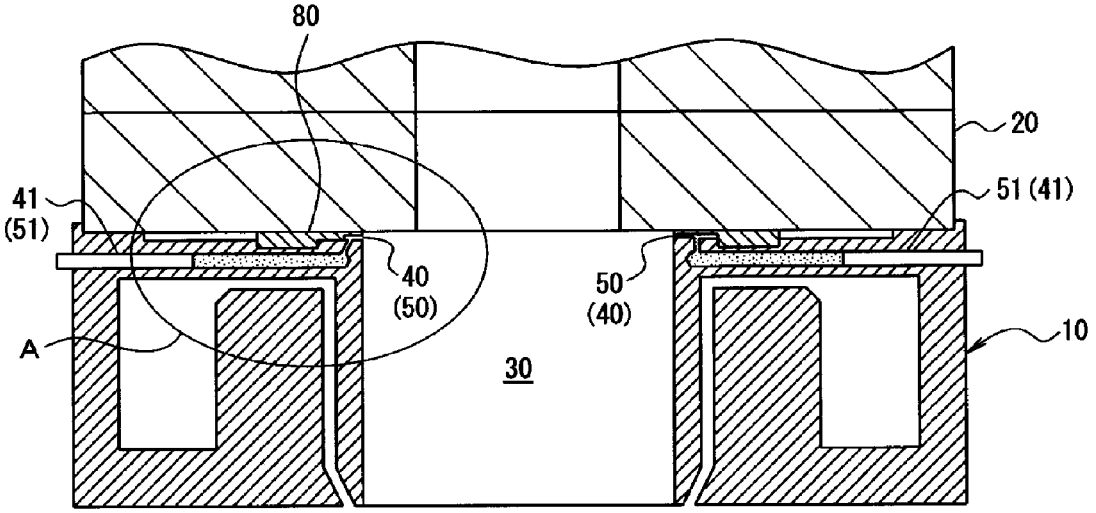
FIG. 5 is a longitudinal sectional view illustrating a second embodiment of the gas pressure controlled casting mold 100 in accordance with the present invention.

The billet B of 6061 aluminum alloy is cast under the same three conditions as those for the second example except that the mold 100 configured to include the ring plate 80 having the lubricating oil blow-out holes 40 and gas passage holes 50 with the rectangular shape of 0.4 mm×0.2 mm as illustrated in FIGS. 5 and 6 is used. Afterward, when the surface state of each billet B is visually checked, a ripple of a large width of 2 to 3 mm is observed at casting speed of 350 mm/min in the same manner as for the second example, but when the casting speed is increased to 600 mm/min, the ripple becomes small and smooth, and the ripple width becomes smaller to as much as 1 to 2 mm. Further, when the casting speed is increased to 900 mm/min, a smooth skin is maintained and each billet B having a favorable skin with unobserved ripples is obtained. Moreover, when facing in a depth of 2 mm from the surface is performed on the each billet B under the above three conditions to check for any internal defect with a stereomicroscope, the defects of ripples, inclusions, oxide films, and blowholes were not detected from any of the billets B.

Fourth Example

The mold 100 configured to include the ring plate 80 having the lubricating oil blow-out holes 40 and gas passage holes 50 with the rectangular shape of 0.4 mm×0.2 mm is used as illustrated in FIGS. 5 and 6. A billet B of 6061 aluminum alloy is cast under the conditions of the gas pressure controlled at the atmospheric pressure plus 50 hPa, castor oil used as the lubricating oil at 0.18 cc/min, and a casting speed of 600 mm/min. Then, the surface state of each billet continues to be visually checked. After the casting starts, a favorable skin appears, but later, a surface defect called a comet tail occurs. In order to remove substances causing the comet tail, the gas pressure is controlled to reduce to the atmospheric pressure plus 10 hPa, increasing the meniscus, and then the gas pressure is controlled to return to the original atmospheric pressure plus 50 hPa. This operation successfully removes the comet tail. The substances causing the comet tail adhered to the mold are found at the end of the comet tail. Afterward, when this operation is periodically performed, no comet tail occurs.

First Comparative Example

Figure 10:
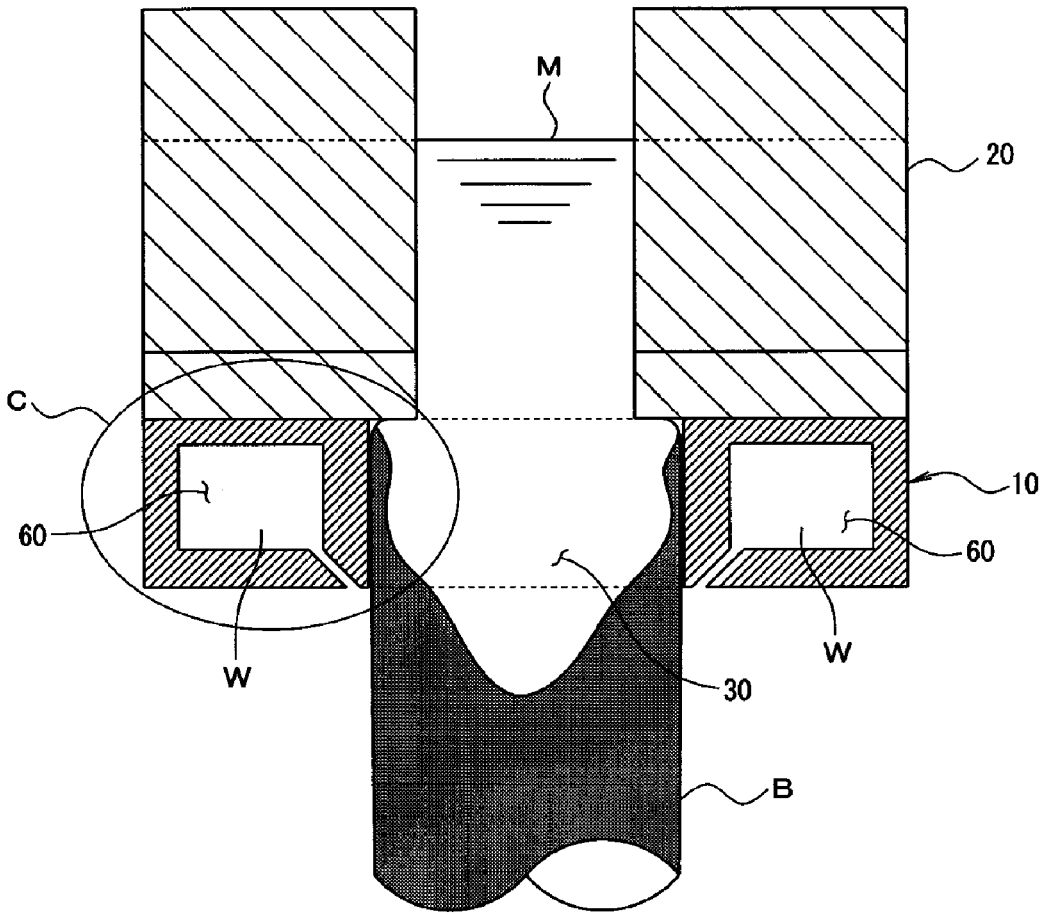
FIG. 10 is a longitudinal sectional view illustrating an example of a conventional gas pressurized hot-top casting mold.
Figure 11:
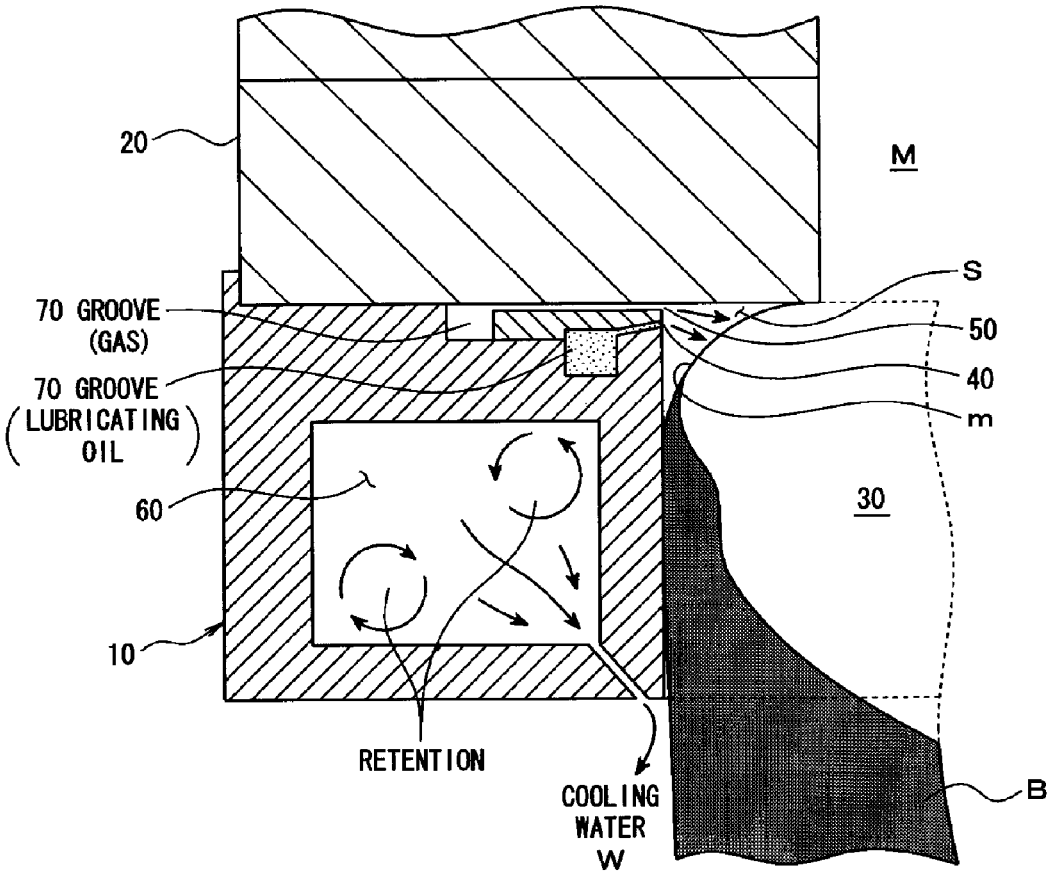
FIG. 11 is a partially enlarged view illustrating the portion C in FIG. 10.

As illustrated in FIG. 10, a mold configured to include the lubricating oil blow-out hole as is and eliminating the gas passage hole is used to cast a billet B of A390 aluminum alloy under the conditions of a molten metal temperature of 800° C., a molten metal height of 10 cm, castor oil used as the lubricating oil at 0.18 cc/min, and a casting speed of 400 mm/min. Note that the mold 100 includes a molten metal passage portion 30 having an internal diameter of 100 mmϕ at the upper portion thereof and an internal diameter of 101 mmϕ at the lower portion thereof, and four lubricating oil blow-out holes provided at equal intervals with a diameter of 0.3 mmϕ at the upper ends of the wall surface of the molten metal passage portion 30. After the casting starts, shallow ripples continue, but no bubbling due to lubricating oil occurs. However, when the surface state of the billet B is visually checked afterward, occasionally a dangling skin occurs in the mold. Further, when the casting continues, a pull crack occurs as the dangling portion is torn apart. Still further, when the casting continues, metal leaks from the pull crack portion, and thus the casting is stopped.

Second Comparative Example

A mold configured as illustrated in FIG. 10 is used to cast three billets B of 6061 aluminum alloy under the conditions of a molten metal temperature of 700° C., a molten metal height of 22 cm, a gas pressure control performed under the atmospheric pressure plus 50 hPa, castor oil used as the lubricating oil at 0.18 cc/min, and a casting speed changed at 350 mm/min, 600 mm/min, and 900 mm/min. While casting, when the surface state of each billet B is visually checked, only a small ripple skin is observed at a casting speed of 350 mm/min, but the billet B cast at a casting speed of 600 mm/min generates a continuous shrinking skin after reaching the speed, then pull crack occurs and molten metal leaks therefrom. We have no other choice but to stop casting. At a casting speed of 900 mm/min, in the same way, a shrinking skin generates a pull crack more quickly, and molten metal leaks therefrom. We have no other choice but to stop casting.

Third Comparative Example

A mold configured as illustrated in FIG. 10 is used to cast three billets B of 6061 aluminum alloy under the conditions of a molten metal temperature of 700° C., a molten metal height of 22 cm, gas pressure control performed under at atmospheric pressure plus 50 hPa, castor oil used as the lubricating oil at 1.2 cc/min, and a casting speed changed at 350 mm/min, 600 mm/min, and 900 mm/min. At a casting speed of 350 mm/min, a large deep ripple occurs. The billet B cast at a casting speed of 600 mm/min generates a small ripple. At a casting speed of 900 mm/min, bubbling occurs frequently. The bubbling causes a pull crack and the molten metal leaks therefrom. We have no other choice but to stop casting.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A gas pressure controlled casting mold, comprising:

a hot-top introducing a molten metal of aluminum or aluminum alloy;

a mold body having an outer circumferential surface and defining a molten metal passage portion having an inner wall surface, wherein the mold body passes the molten metal of aluminum or aluminum alloy introduced from the hot-top through the molten metal passage portion to cool and solidify and semi-continuously or continuously cast a billet of aluminum or aluminum alloy;

a gas passage hole for passing a gas located on the inner wall surface of the molten metal passage portion of the mold body;

a gas supply inlet for supplying the gas located on the outer circumferential surface;

a gas passage having a substantially uniform cross section extending in a horizontal direction relative to a vertical axis of the mold body and communicatively connected from the gas supply inlet to the gas passage hole;

a meniscus portion space formed among an upper end of the mold body, the hot-top, and a molten metal meniscus portion; and a trap mechanism configured to trap a lubricating oil in the meniscus portion space flowing back into the gas passage from the gas passage hole, when a gas pressure in the meniscus portion space is increased, wherein the gas passage is coaxially aligned with both the gas supply inlet and the gas passage hole.

2. A gas pressure controlled casting mold, comprising a hot-top introducing a molten metal of aluminum or aluminum alloy;

a mold body having an outer circumferential surface and defining molten metal passage portion having an inner wall surface, wherein the mold body passes the molten metal of aluminum or aluminum alloy introduced from the hot-top through the molten metal passage portion to cool and solidify and semi-continuously or continuously cast a billet of aluminum or aluminum alloy;

a plurality of lubricating oil blow-out holes for blowing out a lubricating oil arranged circumferentially at equal intervals on the inner wall surface of the molten metal passage portion;

a plurality of gas passage holes for passing a gas arranged circumferentially at equal intervals on the inner circumferential surface of the molten metal passage portion;

a plurality of lubricating oil supply passages extending from the outer circumferential surface and passing through the mold body, each lubricating oil supply passage connecting to one of the plurality of lubricating oil blow-out holes, respectively;

a plurality of gas passages extending from the outer circumferential surface and passing through the mold body, each gas passage connecting to one of the plurality of gas passage holes;

a meniscus portion space formed among an upper end of the mold body, the hot-top, and a molten metal meniscus portion;

a trap mechanism configured to trap the lubricating oil together in the meniscus portion space flowing back into the gas passage from the gas passage hole, when a gas pressure in the meniscus portion space is increased; and a ring-shaped cover plate arranged on a top surface of the mold body to be concentric to the molten metal passage portion, the ring-shaped cover plate covering the plurality of lubricating oil supply passages and the plurality of gas passages, wherein each of the plurality of lubricating oil supply passages is not connected to any other lubricating oil supply passage by an annular groove, but is connected independently to the one of the plurality of lubricating oil blow-out holes, wherein each of the plurality of gas passages is not connected to any other gas passage by an annular groove, but is connected independently to the one of the plurality of gas passage holes, wherein each of the plurality of lubricating oil blow-out holes is spaced apart from each of the plurality of gas passage holes, wherein each of the plurality of lubricating oil blow-out holes is provided horizontally on a same level with each of the plurality of gas passage holes relative to a vertical axis of the mold body, and wherein the plurality of lubricating oil supply passages and the plurality of gas passages extend horizontally on a same plane relative to the vertical axis of the mold body, such that the lubricating oil and the gas are independently supplied to the molten metal in different directions from each other.

3. A gas pressure controlled casting mold comprising:

a hot-top introducing a molten metal of aluminum or aluminum alloy;

a mold body having an outer circumferential surface and defining a molten metal passage portion having an inner wall surface, wherein the mold body passes the molten metal of aluminum or aluminum alloy introduced from the hot-top through the molten metal passage portion to cool and solidify and semi-continuously or continuously cast a billet of aluminum or aluminum alloy;

a ring plate provided substantially concentric to the molten metal passage portion on an upper surface of the mold body to be detachable from the mold body;

a plurality of lubricating oil blow-out holes, arranged on an inner circumferential surface side on a lower surface of the ring plate, for blowing out a lubricating oil arranged circumferentially at equal intervals in the ring plate;

a plurality of gas passage holes, arranged on the inner circumferential surface side on the lower surface of the ring plate, for passing a gas arranged circumferentially at equal intervals in the ring plate;

a plurality of lubricating oil supply passages extending from an outer circumferential surface and passing through the mold body, each lubricating oil supply passage connecting to one of the plurality of lubricating oil blow-out holes in the ring plate;

a plurality of gas passages extending from the outer circumferential surface and passing through the mold body, each gas passage connecting to one of the plurality of gas passage holes in the ring plate;

a meniscus portion space formed among an upper end of the mold body, the hot-top, and a molten metal meniscus portion; and a trap mechanism configured to trap the lubricating oil in the meniscus portion space flowing back into the gas passage from the gas passage hole, when a gas pressure in the meniscus portion space is increased, wherein each of the plurality of lubricating oil supply passages is not connected to any other lubricating oil supply passage by an annular groove, but connected independently to each of the plurality of lubricating oil blow-out holes, wherein each of the plurality of gas passages is not connected to any other gas passage by an annular groove, but is connected independently to the one of the plurality of gas passage holes, and wherein each of the plurality of lubricating oil blow-out holes is spaced apart from each of the plurality of gas passage holes, and is provided horizontally on a same level with each of the plurality of gas passage holes relative to a vertical axis of the mold body, such that the lubricating oil and the gas are independently supplied to the molten metal introduced through the molten metal passage portion in different directions from each other.

4. The gas pressure controlled casting mold according to claim 3, wherein any one or both of the mold body and the ring plate is formed of copper or copper alloy.

5. The gas pressure controlled casting mold according to claim 2, further comprising:

a refrigerant passage formed in the mold body; and a blow-out hole or a blow-out slit formed at a lower end of the molten metal passage portion for blowing out a refrigerant flowing through the refrigerant passage toward a solidified shell of aluminum or aluminum alloy continuously formed by the molten metal passage portion of the mold body; wherein the blow-out hole or the blow-out slit for the refrigerant and the refrigerant passage in the mold body are connected by using a communication path extending downward from an upper end side of the molten metal passage portion near the molten metal passage portion.

6. The gas pressure controlled casting mold according to claim 2, further comprising:

a refrigerant passage formed in the mold body; and a blow-out hole or a blow-out slit formed at a lower end of the molten metal passage portion for blowing out a refrigerant flowing through the refrigerant passage toward a solidified shell of aluminum or aluminum alloy continuously formed by the molten metal passage portion of the mold body; wherein the blow-out hole or the blow-out slit for the refrigerant and the refrigerant passage in the mold body are connected by using a vertical communication path extending downward from an upper end side of the molten metal passage portion and a horizontal communication path extending inward in a substantially horizontal direction directly under a gas passage of the plurality of gas passages or a lubricating oil supply passage of the plurality of lubricating oil supply passages, near the molten metal passage portion.

7. The gas pressure controlled casting mold according to claim 2, further comprising:

a communication hole formed for pressure measurement in the mold body;

a pressure measurement unit provided on the communication hole for measuring a pressure of the meniscus portion; and a pressure control unit provided at a gas passage of the plurality of gas passages or a lubricating oil supply passage of the plurality of lubricating oil supply passages for controlling a pressure of the meniscus portion space based on a measured value measured by the pressure measurement unit.

8. The gas pressure controlled casting mold according to claim 7, wherein the pressure control unit regulates an amount of lubricating oil supply supplied from the lubricating oil supply passage and controls the pressure of the meniscus portion space.

9. The gas pressure controlled casting mold according to claim 7, wherein the pressure control unit controls the pressure of the meniscus portion space by increasing or decreasing a gas pressure in the gas passage.

10. The gas pressure controlled casting mold according to claim 1, further comprising:

a communication hole formed for pressure measurement in the mold body;

a pressure measurement unit provided on the communication hole for measuring a pressure of the meniscus portion; and a pressure control unit provided at the gas passage for controlling a pressure of the meniscus portion space based on a measured value measured by the pressure measurement unit.

11. The gas pressure controlled casting mold according to claim 10, wherein the pressure control unit controls the pressure of the meniscus portion space by increasing or decreasing a gas pressure in the gas passage.

12. The gas pressure controlled casting mold according to claim 3, further comprising:

a refrigerant passage formed in the mold body; and a blow-out hole or a blow-out slit formed at a lower end of the molten metal passage portion for blowing out a refrigerant flowing through the refrigerant passage toward a solidified shell of aluminum or aluminum alloy continuously formed by the molten metal passage portion of the mold body; wherein the blow-out hole or the blow-out slit for the refrigerant and the refrigerant passage in the mold body are connected by using a vertical communication path extending downward from an upper end side of the molten metal passage portion and a horizontal communication path extending inward in a substantially horizontal direction directly under a gas passage of the plurality of gas passages or a lubricating oil supply passage or the plurality of lubricating oil supply passages, near the molten metal passage portion.

13. The gas pressure controlled casting mold according to claim 3, further comprising:

a communication hole formed for pressure measurement in the mold body;

a pressure measurement unit provided on the communication hole for measuring a pressure of the meniscus portion space; and a pressure control unit provided at a gas passage of the plurality of gas passages or a lubricating oil supply passage of the plurality of lubricating oil supply passages for controlling a pressure of the meniscus portion space based on a measured value measured by the pressure measurement unit.

14. The gas pressure controlled casting mold according to claim 3, wherein the trap mechanism connects a drain pipe to the gas passage for discharging the lubricating oil, and wherein the drain pipe is comprised of a trap including a closed container and a pressure reducing valve.

15. A gas pressure controlled casting mold, comprising:

a hot-top introducing a molten metal of aluminum or aluminum alloy;

a mold body having an outer circumferential surface and defining molten metal passage portion having an inner wall surface, wherein the mold body passes the molten metal of aluminum or aluminum alloy introduced from the hot-top through the molten metal passage portion to cool and solidify and semi-continuously or continuously cast a billet of aluminum or aluminum alloy;

a lubricating oil blow-out hole for blowing out a lubricating oil arranged on the inner wall surface of the molten metal passage portion;

a gas passage hole for passing a gas arranged on the inner circumferential surface of the molten metal passage portion;

a lubricating oil supply inlet for supplying the lubricating oil located on the outer circumferential surface of the mold body;

a gas supply inlet for supplying the gas located on the outer circumferential surface of the mold body;

a lubricating oil supply passage having a substantially uniform cross section extending in a horizontal direction relative to a vertical axis of the mold body and communicatively connected from the lubricating oil supply inlet to the lubricating oil blow-out hole;

a gas passage having a substantially uniform cross section extending in the horizontal direction relative to the vertical axis of the mold body and communicatively connected from the gas supply inlet to the gas passage hole;

a meniscus portion space formed among an upper end of the mold body, the hot-top, and a molten metal meniscus portion; and a trap mechanism configured to trap the lubricating oil in the meniscus portion space flowing back into the gas passage from the gas passage hole, when a gas pressure in the meniscus portion space is increased, wherein the lubricating oil supply passage is coaxially aligned with both the lubricating oil supply inlet and the lubricating oil blow-out hole, wherein the gas passage is coaxially aligned with both the gas supply inlet and the gas passage hole, wherein the lubricating oil supply passage and the gas passage are spaced apart from each other, wherein the lubricating oil blow-out hole is provided horizontally on a same level with the lubricating oil hole relative to a vertical axis of the mold body, and wherein the lubricating oil supply passage and the gas passage extend horizontally on a same plane relative to the vertical axis of the mold body, such that the lubricating oil and the gas are independently supplied to the molten metal in different directions from each other.

16. The gas pressure controlled casting mold according to claim 2, wherein one of the plurality of lubricating oil passages and one of the plurality of gas passages are alternately arranged on the same plane relative to the vertical axis of the mold body.

17. The gas pressure controlled casting mold according to claim 3, wherein one of the plurality of lubricating oil passages and one of the plurality of gas passages are alternately arranged on the same plane relative to the vertical axis of the mold body.

18. The gas pressure controlled casting mold of claim 15, further comprising:

a supply of the gas arranged outside of the outer circumferential surface to supply the gas to the plurality of gas passages; and a supply of the lubricating oil arranged outside of the outer circumferential surface of the mold body to supply the lubricating oil to the plurality of lubricating oil supply passages.

19. The gas pressure controlled casting mold of claim 2, further comprising:

a supply of the gas arranged outside of the outer circumferential surface to supply the gas to the plurality of gas passages; and a supply of the lubricating oil arranged outside of the outer circumferential surface of the mold body to supply the lubricating oil to the plurality of lubricating oil supply passages.

20. A gas pressure controlled casting mold, comprising:

a hot-top introducing a molten metal of aluminum or aluminum alloy;

a mold body having an outer circumferential surface and defining a molten metal passage portion having an inner wall surface, wherein the mold body passes the molten metal of aluminum or aluminum alloy introduced from the hot-top through the molten metal passage portion to cool and solidify and semi-continuously or continuously cast a billet of aluminum or aluminum alloy;

a lubricating oil blow-out hole in the inner wall surface of the mold body configured to blow out a lubricating oil;

a lubricating oil supply inlet in the outer circumferential surface of the mold body configured to supply the lubricating oil;

a lubricating oil supply passage having a substantially uniform cross section horizontally, communicatively connected from the lubricating oil supply inlet to a vicinity of the lubricating oil blow-out hole;

a meniscus portion space formed among an upper end of the mold body, the hot-top, and a molten metal meniscus portion; and a trap mechanism configured to trap the lubricating oil in the meniscus portion space flowing back through a pressure measurement communication hole that is communicatively connected to the meniscus portion space, when a gas pressure in the meniscus portion space is increased, wherein the lubricating oil supply passage is coaxially aligned with both the lubricating oil supply inlet and the lubricating oil blow-out hole.

* * * * *